US010458104B2

(12) United States Patent
McAlpine et al.

(10) Patent No.: US 10,458,104 B2
(45) Date of Patent: Oct. 29, 2019

(54) HIGH FLOW DRAIN CONTROL

(71) Applicant: McAlpine & Co. Ltd., Glasgow, Strathclyde (GB)

(72) Inventors: James Edward McAlpine, Paisley (GB); Robert Gemmell McAlpine, Glasgow (GB); Christopher McKendrick, Glasgow (GB)

(73) Assignee: McAlpine & Co. Ltd., Glasgow (GB)

( * ) Notice: Subject to any disclaimer, the term of this patent is extended or adjusted under 35 U.S.C. 154(b) by 154 days.

(21) Appl. No.: 15/663,080

(22) Filed: Jul. 28, 2017

(65) Prior Publication Data

US 2018/0030706 A1 Feb. 1, 2018

(30) Foreign Application Priority Data

Aug. 1, 2016 (GB) ..... 1613213.6

(51) Int. Cl.
*E03C 1/23* (2006.01)
*A47K 1/14* (2006.01)

(52) U.S. Cl.
CPC ..... *E03C 1/2302* (2013.01); *A47K 1/14* (2013.01); *Y10T 137/7225* (2015.04)

(58) Field of Classification Search
CPC .... E03C 1/2302; A47K 1/14; Y10T 137/7225
USPC .... 4/689–692, 287, 285; 251/231, 235, 279, 251/297
See application file for complete search history.

(56) References Cited

U.S. PATENT DOCUMENTS

| | | | |
|---|---|---|---|
| 24,476 | A | 6/1859 | Mayall |
| 175,145 | A | 3/1876 | Painter |
| 194,329 | A | 8/1877 | Buhrer |
| 208,379 | A | 9/1878 | Downey |
| 419,219 | A | 1/1890 | Rosenfield |
| 892,690 | A | 10/1897 | Bragger |
| 605,202 | A | 6/1898 | Mullenhoff |
| 729,996 | A | 6/1903 | Bonnell |
| RE12,307 | E | 1/1905 | Bonnell |
| 803,979 | A | 11/1905 | Bonnell |
| 838,001 | A | 12/1906 | Bonnell et al. |

(Continued)

FOREIGN PATENT DOCUMENTS

| | | |
|---|---|---|
| BE | 649925 | 10/1964 |
| CA | 2081980 A1 | 11/1991 |

(Continued)

OTHER PUBLICATIONS

UK IPO Examination Report, GB 1613213.6, dated Dec. 6, 2016.

(Continued)

*Primary Examiner* — Jessica Cahill
*Assistant Examiner* — Patrick C Williams
(74) *Attorney, Agent, or Firm* — Colby Nipper PLLC

(57) ABSTRACT

A lockable plug device for sanitary ware comprises a closure member operable to engage with an outlet or drain of the sanitary ware product to stop water emptying from the sanitary ware product, for example a bath. The lockable plug device also includes a closure mechanism, which is linked to the closure member and is operable to displace the closure member relative to the outlet or drain such that the outlet can be open or closed. The closure mechanism comprises a lock feature, which is operable to lock the closure member in an open position.

17 Claims, 3 Drawing Sheets

(56) References Cited

U.S. PATENT DOCUMENTS

| | | | | |
|---|---|---|---|---|
| 859,540 | A | 7/1907 | Bonnell | |
| 1,000,087 | A | 8/1911 | Goliner | |
| 1,035,849 | A * | 8/1912 | Bergens | E03C 1/23 251/237 |
| 1,536,127 | A | 5/1925 | Newton | |
| 1,758,226 | A * | 5/1930 | Kaufman | E03C 1/23 251/75 |
| 2,352,642 | A | 7/1944 | Langdon | |
| 2,593,734 | A | 4/1952 | Lou | |
| 2,617,491 | A | 11/1952 | Ross | |
| 2,630,874 | A | 3/1953 | Langdon | |
| 2,675,823 | A | 4/1954 | Langdon | |
| 2,689,959 | A * | 9/1954 | Gulick | E03C 1/23 4/692 |
| 2,917,070 | A | 12/1959 | Langdon | |
| 2,990,849 | A | 7/1961 | Lucien | |
| 3,060,882 | A | 10/1962 | Peters et al. | |
| 3,107,687 | A | 10/1963 | Howe | |
| 3,237,616 | A | 3/1966 | Daigh et al. | |
| 3,334,646 | A | 8/1967 | Billeter et al. | |
| 3,422,844 | A | 1/1969 | Grise | |
| 3,460,168 | A | 8/1969 | Bruyne | |
| 3,463,159 | A | 8/1969 | Heimlich | |
| 3,572,375 | A | 3/1971 | Rosenberg | |
| 3,707,986 | A | 1/1973 | Breen | |
| 3,967,645 | A | 7/1976 | Gregory | |
| 3,994,031 | A | 11/1976 | Bishop | |
| 4,230,582 | A | 10/1980 | Tuleja | |
| 4,284,097 | A | 8/1981 | Becker et al. | |
| 4,411,028 | A * | 10/1983 | Hogner | E03C 1/2304 4/691 |
| 4,440,406 | A | 4/1984 | Ericson | |
| 4,596,057 | A * | 6/1986 | Ohta | E03C 1/2304 4/295 |
| 4,605,041 | A | 8/1986 | Teumer | |
| 4,612,960 | A | 9/1986 | Edwards et al. | |
| 4,681,131 | A | 7/1987 | Uriarte | |
| 4,809,739 | A | 3/1989 | Scaramucci | |
| 4,945,940 | A | 8/1990 | Stevens | |
| 5,215,118 | A | 6/1993 | Scaramucci | |
| 5,441,679 | A | 8/1995 | Chalich | |
| 5,606,995 | A | 3/1997 | Raftis | |
| 5,727,593 | A | 3/1998 | Duer | |
| 5,819,328 | A | 10/1998 | Lewis | |
| 5,836,484 | A | 11/1998 | Gerber | |
| 6,044,859 | A | 4/2000 | Davis | |
| 6,394,364 | B1 | 5/2002 | Abplanalp | |
| 6,453,940 | B1 | 9/2002 | Tipton et al. | |
| 6,481,464 | B1 | 11/2002 | Katayama et al. | |
| 6,482,181 | B1 | 11/2002 | Racenet et al. | |
| 6,527,011 | B1 | 3/2003 | Mantz | |
| 6,585,005 | B1 | 7/2003 | Raftis et al. | |
| 6,705,339 | B2 | 3/2004 | Colton, Sr. | |
| 6,795,987 | B2 | 9/2004 | Cornwall | |
| 7,216,377 | B2 | 5/2007 | Nocera et al. | |
| 7,243,681 | B2 | 7/2007 | Dahm | |
| 7,246,386 | B2 | 7/2007 | Hall | |
| 7,509,978 | B1 | 3/2009 | Currid | |
| 7,530,369 | B2 | 5/2009 | Anderson | |
| 7,717,129 | B2 | 5/2010 | Steppe et al. | |
| 7,905,243 | B2 | 3/2011 | Minard et al. | |
| 9,567,737 | B2 | 2/2017 | McAlpine | |
| 10,030,374 | B2 | 7/2018 | McAlpine | |
| 2003/0111122 | A1 | 6/2003 | Horton | |
| 2004/0050427 | A1 | 3/2004 | Ryabtsev | |
| 2005/0229971 | A1 | 10/2005 | Higgins | |
| 2006/0101565 | A1 | 5/2006 | Cummings | |
| 2006/0266422 | A1 | 11/2006 | Feenstra et al. | |
| 2007/0138327 | A1 | 6/2007 | Berger | |
| 2008/0066816 | A1 | 3/2008 | Steppe et al. | |
| 2010/0000298 | A1 | 1/2010 | Swaffield et al. | |
| 2010/0180962 | A1 | 7/2010 | Degutis et al. | |
| 2010/0205725 | A1 | 8/2010 | McAlpine | |
| 2011/0036417 | A1 | 2/2011 | McAlpine | |
| 2011/0132474 | A1 | 6/2011 | Reese et al. | |
| 2011/0185494 | A1 * | 8/2011 | Beck | E03C 1/23 4/689 |
| 2011/0220211 | A1 | 9/2011 | Larkin et al. | |
| 2011/0277229 | A1 | 11/2011 | Connor | |
| 2012/0192950 | A1 | 8/2012 | Huber | |
| 2013/0000766 | A1 | 1/2013 | McAlpine et al. | |
| 2014/0059761 | A1 * | 3/2014 | Bohacik | E03C 1/2302 4/688 |
| 2014/0130899 | A1 | 5/2014 | McAlpine | |
| 2014/0373931 | A1 | 12/2014 | Huber | |
| 2015/0176261 | A1 | 6/2015 | McAlpine | |
| 2016/0090722 | A1 | 3/2016 | McAlpine | |
| 2016/0230375 | A1 | 8/2016 | McAlpine | |
| 2017/0260725 | A1 | 9/2017 | McAlpine | |

FOREIGN PATENT DOCUMENTS

| | | | |
|---|---|---|---|
| CA | 2722310 | | 5/2012 |
| CA | 2828793 | | 9/2012 |
| CN | 2448877 | Y | 9/2000 |
| CN | 2604585 | | 2/2004 |
| CN | 1520497 | | 8/2004 |
| CN | 2632167 | | 8/2004 |
| CN | 1551940 | | 12/2004 |
| CN | 2667026 | | 12/2004 |
| CN | 1754057 | | 3/2006 |
| CN | 101516419 | | 8/2009 |
| CN | 102333922 | | 1/2012 |
| CN | 202220366 | | 5/2012 |
| DE | 2401869 | | 7/1975 |
| DE | 20302114 | | 4/2003 |
| DE | 20320636 | | 11/2004 |
| DE | 202009018443 | | 9/2011 |
| DE | 202011050359 | | 10/2011 |
| EP | 0139347 | | 5/1985 |
| EP | 0487215 | | 5/1992 |
| EP | 1059391 | | 12/2000 |
| EP | 1174549 | | 1/2002 |
| EP | 1666676 | | 6/2006 |
| FR | 25998197 | | 4/1986 |
| FR | 2630763 | | 11/1989 |
| FR | 2712165 | A1 | 8/1993 |
| FR | 2598197 | | 9/1998 |
| GB | 754497 | | 8/1956 |
| GB | 1013359 | | 12/1965 |
| GB | 2041422 | | 9/1980 |
| GB | 2153048 | | 8/1985 |
| GB | 2190466 | | 11/1987 |
| GB | 2296309 | | 6/1996 |
| GB | 2320310 | | 6/1998 |
| GB | 2421518 | | 6/2006 |
| JP | 11172736 | | 6/1999 |
| JP | 2001152508 | | 6/2001 |
| JP | 2004124531 | | 4/2004 |
| JP | 2003049464 | A | 9/2004 |
| JP | 2006138065 | | 6/2006 |
| KR | 101166553 | | 7/2012 |
| NL | 8200799 | | 9/1983 |
| RU | 2268216 | | 11/2004 |
| WO | 0226392 | | 4/2002 |
| WO | 030210449 | | 3/2003 |
| WO | 2004059198 | | 7/2004 |
| WO | 2007021049 | | 2/2007 |
| WO | 2008134808 | | 11/2008 |
| WO | 2009001115 | | 12/2008 |
| WO | 2010096885 | | 9/2010 |
| WO | 2012065269 | | 5/2012 |
| WO | 2014188185 | | 11/2014 |

OTHER PUBLICATIONS

"Notice of Allowance", U.S. Appl. No. 12/810,139, dated Dec. 4, 2018, 7 pages.

"Canadian IPO Office Action", Canadian IPO Application No. 2,710,488, dated Sep. 26, 2014, 8 pgs.

"Communication pursuant to Article 94(3) EPC", EP Application No. 10788374.6, dated Mar. 11, 2015, 2 pgs.

(56) References Cited

OTHER PUBLICATIONS

"Ex Parte Quayle Action", U.S. Appl. No. 14/892,806, dated Jun. 17, 2018, 9 pgs.
"Examination Report", Australian Application No. 2010320652, dated Feb. 15, 2016, 3 pgs.
"Examination Report", Canadian Application No. 2786552, dated May 12, 2017, 3 pgs.
"Examination Report", Canadian Application No. 2786552, dated Sep. 9, 2016, 3 pgs.
"Examination Report", Australian Application No. 2010320652, dated Dec. 11, 2014, 4 pgs.
"Examination Report", AE Application No. UAE/P/0527/2012—Exam report issued by KIPO, dated Nov. 7, 2016, 9 pgs.
"Final Office Action", U.S. Appl. No. 15/024,163, dated Nov. 1, 2017, 10 pgs.
"Final Office Action", U.S. Appl. No. 13/511,393, dated Dec. 1, 2014, 11 pgs.
"Final Office Action", U.S. Appl. No. 14/403,988, dated Dec. 15, 2016, 13 pgs.
"Final Office Action", U.S. Appl. No. 13/511,393, dated Jun. 15, 2016, 14 pgs.
"Final Office Action", U.S. Appl. No. 14/403,988, dated Dec. 15, 2017, 18 pgs.
"Final Office Action", U.S. Appl. No. 12/810,139, dated Jan. 10, 2018, 21 pgs.
"Final Rejection Action", U.S. Appl. No. 12/810,139, dated Sep. 16, 2015, 14 pgs.
"Final Rejection Action", U.S. Appl. No. 12/810,139, dated Apr. 20, 2016, 15 pgs.
"Final Rejection Action", U.S. Appl. No. 12/810,139, dated Apr. 24, 2017, 20 pgs.
"Final Rejection Action", U.S. Appl. No. 12/810,139, dated Jun. 25, 2014, 26 pgs.
"International Preliminary Report on Patentability", PCT Application No. PCT/GB2014/052868, dated Mar. 29, 2016, 6 pgs.
"International Search Report", U.S. Appl. No. 15/520,460, dated Apr. 28, 2016, 2 pgs.
"International Search Report", PCT Application No. PCT/GB2010/002158, dated Mar. 1, 2011, 5 pgs.
"International Search Report and Written Opinion", PCT Application No. PCT/GB2014/052868, dated Dec. 12, 2014, 10 pgs.
"International Search Report and Written Opinion", PCT Application No. PCT/GB2014/051554, dated Aug. 20, 2014, 12 pgs.
"International Search Report and Written Opinion", PCT Application No. PCT/GB2013/000241, dated Sep. 12, 2013, 13 pgs.
"IP Australia Examination Report 1", IP Australia Application No. 2008339614, dated Mar. 13, 2014, 3 pgs.
"Non-Final Office Action", U.S. Appl. No. 13/511,393, dated Feb. 7, 2014, 10 pgs.
"Non-Final Office Action", U.S. Appl. No. 15/024,163, dated Feb. 8, 2018, 10 pgs.
"Non-Final Office Action", U.S. Appl. No. 14/403,988, dated Jul. 28, 2016, 13 pgs.
"Non-Final Office Action", U.S. Appl. No. 12/810,139, dated Mar. 11, 2013, 13 pgs.
"Non-Final Office Action", U.S. Appl. No. 14/403,988, dated Jul. 14, 2017, 15 pgs.
"Non-Final Office Action", U.S. Appl. No. 12/810,139, dated Nov. 20, 2014, 16 pgs.
"Non-Final Office Action", U.S. Appl. No. 15/520,460, dated Mar. 29, 2018, 16 pgs.
"Non-Final Office Action", U.S. Appl. No. 14/892,806, dated Jul. 20, 2017, 17 pgs.
"Non-Final Office Action", U.S. Appl. No. 12/810,139, dated Sep. 30, 2016, 18 pgs.
"Non-Final Office Action", U.S. Appl. No. 12/810,139, dated Nov. 15, 2013, 19 pgs.
"Non-Final Office Action", U.S. Appl. No. 12/810,139, dated May 4, 2018, 20 pgs.
"Non-Final Office Action", U.S. Appl. No. 13/511,393, dated May 22, 2013, 7 pgs.
"Non-Final Office Action", U.S. Appl. No. 13/511,393, dated Nov. 10, 2015, 7 pgs.
"Non-Final Office Action", U.S. Appl. No. 15/024,163, dated May 19, 2017, 8 pgs.
"Non-Final Office Action", U.S. Appl. No. 13/511,393, dated Jun. 18, 2015, 9 pgs.
"Notice of Allowance", U.S. Appl. No. 14/892,806, dated Mar. 27, 2018, 8 pgs.
"Notice of Allowance", U.S. Appl. No. 13/511,393, dated Sep. 27, 2016, 8 pgs.
"Notice of Allowance", U.S. Appl. No. 12/810,139, dated Aug. 23, 2017, 9 pgs.
"Office Action for Chinese Patent Application", Chinese Patent Application No. 201510234647.5, dated Apr. 5, 2016, 11 pgs.
"Preliminary Report on Patentability", PCT Application No. PCT/GB2010/002158, dated May 30, 2012, 10 pgs.
"Preliminary Report on Patentability", PCT Application No. PCT/GB2014/051554, dated Nov. 24, 2015, 8 pgs.
"Preliminary Report on Patentability", PCT Application No. PCT/GB2013/000241, dated Dec. 2, 2014, 8 pgs.
"Russian Examination Report w/ Translation", U.S. Appl. No. 12/810,139, dated Dec. 4, 2012, 6 pgs.
"Search Report", EP Application No. 17178570.2, dated Apr. 5, 2018, 11 pgs.
"Search Report", PCT Application No. PCT/GB2010/002158, dated Mar. 1, 2011, 5 pgs.
"Search Report", Ae Application No. UAE/P/0527/2012, Search Report from KIPO, dated Nov. 7, 2016, 4 pgs.
"Search Report and Written Opinion", U.S. Appl. No. 12/810,139 PCT/GB2008/004248, dated Apr. 16, 2009, 10 pgs.
"Singapore Examination Report", U.S. Appl. No. 12/810,139, dated Sep. 7, 2012, 14 pgs.
"Summons to Attend Oral Proceedings", EP Application No. 10788374.5, Jan. 15, 2016, 10 pgs.
"Written Opinion", PCT Application No. PCT/GB2010/002158, dated Mar. 1, 2011, 9 pgs.
"Written Opinion of the ISA", U.S. Appl. No. 15/520,460, dated Apr. 28, 2016, 6 pgs.
"Final Office Action", U.S. Appl. No. 15/520,460, dated Sep. 11, 2018, 18 pages.
"Foreign Office Action", CN Application 201580056927 as retrieved/translated from Global Dossier, dated Jul. 3, 2018, 5 pages.
"Non-Final Office Action", U.S. Appl. No. 14/403,988, dated Jul. 26, 2018, 21 pages.
"Non-Final Office Action", U.S. Appl. No. 15/024,163, dated Sep. 6, 2018, 10 pages.
"Search Report", CN Application No. 201580056927X, dated Jun. 25, 2018, 1 page.

* cited by examiner

HIGH FLOW DRAIN CONTROL

FIELD OF THE INVENTION

The invention relates to a lockable plug for sanitary ware, wherein the plug can be locked in an open position to prevent inadvertent closure. In particular, the invention relates to a lockable plug in a high flow drain situation such as in a walk in bath.

BACKGROUND TO THE INVENTION

Walk in bathtubs are generally equipped with an outlet or drain to facilitate high-flow drainage such that the contents of the bathtub can be emptied as quick as possible to avoid the user remaining in the bathtub for an unnecessary period of time.

A walk in bathtub typically includes an access door for ease of entry and exit, which eliminates the need for a user to straddle the edge of the bathtub to step into or out of the bathtub. Upon entering the bathtub, the access door closes and seals relative to the side of the bathtub such that the bathtub can be filled with water.

Typically, the bathtub needs to be emptied, almost fully, before the door can be opened to avoid water spilling onto the bathroom floor.

Modern bathtubs and sanitary-ware generally include substantially integral plug units which involve closing the outlet/drain from the bath by mechanical means. For example, a pop-up plug, which remains in contact with the outlet at all times. This type of plug changes position or orientation relative to the outlet to close and open the outlet.

In the situation of a high-flow drain these types of plug inserts have the problem that as water exits the bath, the volume of water is capable of generating sufficient force to cause the plug unit to engage with the outlet and therefore halt the draining process. It will be appreciated, in the context of a walk-in bath, this situation is not desirable because the user generally needs to remain in the bath until all or most of the water has drained away.

SUMMARY OF THE INVENTION

According to a first aspect of the present invention there is provided a lockable plug device for sanitary ware, the lockable plug device comprises:

- a closure member operable to sealingly engage with an outlet or drain of the sanitary ware product; and
- a closure mechanism, wherein the closure mechanism is linked to the closure member and is operable to displace the closure member relative to the outlet or drain to open and close the outlet; and wherein the closure mechanism comprises a lock feature, which is operable to lock the closure member in an open position.

The closure mechanism may comprise a primary lever and a secondary lever, each comprising an upper end and a lower end;

- wherein the upper end of the primary lever engages within the upper end of the secondary lever to control movement of the closure member via the lower end of the secondary lever,
- wherein a lower end of the primary lever provides a load point, which is operable to rotate the primary lever about a pivot point thereby creating displacement of the upper end of the primary lever and consequential displacement of the upper end of the secondary lever wherein the levers are operable to move to a locked open position, wherein the upper ends of the primary and secondary levers are locked against rotational displacement unless a load applied to the closure member exceeds a predetermined applied load, wherein the predetermined applied load is the load created by water exiting through the drain hole to which the device is connected.

An example of a load that exceeds the predetermined applied load may be when a user inadvertently steps on the closure member and forces the closure member to move downwards to a closed position due to the weight of the user typically being greater than the load generated by water exiting through the drain to which the closure member is attached.

The upper end of the secondary lever may comprise a slot and upper end of the primary lever may comprise a pin, wherein the pin engages with the slot such that upon rotation of the primary lever relative to the secondary lever the pin is displaced translationally along the slot to an extremity of the slot, wherein the action of the primary lever relative to the secondary lever displaces the closure member to a locked open position when the pin reaches an extremity of the slot.

The arrangement of the primary and secondary levers is such that when the closure member, for example a pop-up plug, is locked in the open position unintentional closure of the closure member, due to a predetermined applied load is avoided due to the configuration of the levers acting together to prevent the pin from moving along the slot.

The slot may be J-shaped comprising a leg portion and a foot portion, wherein the pin locates in the upstanding leg portion of the slot when the closure member is in a closed or partially open/closed position and wherein the pin locates in the foot portion of the J-shaped slot in a locked open position.

Accordingly, to move the closure member between an open and closed position or a closed and open position the pin travels along the slot.

The primary lever may comprise a pivot point located between the upper end and the lower end of the primary lever, wherein the pivot point divides the primary lever into a first arm and a second arm.

The first arm may extend between the upper end and the pivot and the second arm may extend between the lower end and the pivot, wherein the first arm may be longer than the second arm.

The secondary lever may be straight. The primary lever may comprise a bend, wherein the pivot point is located at the bend. The bend may be located between the lower end and half way along the lever.

The primary lever may comprise a pivotal member coincident with the lower end of the secondary lever. The pivotal member may comprise a shaft configured to rotate upon action of the secondary lever relative to the primary lever, wherein an extension member may extend from the shaft, wherein the extension member may be operable to interact with the closure member to displace the closure member between open and closed positions.

The extension member may extend, substantially perpendicular to the rotational axis of the shaft such that upon rotation of the secondary lever about the pivot point the shaft rotates and the extension member traces an arc and thereby interacts with the closure member to provide directional displacement of the closure member.

The extension member may be a rod. The rod may be attached to the shaft and extends, substantially perpendicular to the axis of the shaft such that upon rotation of the primary lever about the pivot point the shaft rotates and the rod traces an arc up or down and thereby interacts with the closure member to provide directional displacement of the closure member.

The closure mechanism is configured such that intentional closure of the closure member is controlled by applying a load to the lower end of the primary lever to rotate the upper end relative to the pivot point, wherein the primary and secondary levers are engaged and move relative to each other by applying a load to the lower end of the primary lever to rotate the upper end such that intentional closure of the closure member is controlled.

The arrangement and configuration of the primary lever and the secondary lever is such that maximum leverage is attainable when moving the closure member from the closed position because the act of opening requires the application of a load to the lower end of the primary lever to overcome the weight of water on the closure member when, for example a bathtub is full of water.

The locking feature is configured, in a locked open position, to withstand a closing force generated by water flowing through the drain, in particular in a high flow drain arrangement. As such unintentional closure of the closure member can be prevented.

However, there may be situation where the load applied to the closure member exceeds the load associated with water draining through the drain hole or outlet, for example if someone steps on the closure member and forces it downwards into a closed position.

In the event that the load applied to the closure member exceeds the load associated with water draining through the system the closure mechanism may comprise a failsafe component or override feature, which is operable to allow the closure member to close, but ensures continued engagement of the upper ends of the primary lever and the secondary lever.

The failsafe component or override feature may comprise a recess adjacent to the slot, wherein the recess is shallower than the slot, such that a step is defined to one side of the slot, wherein the step acts as a guide for the upper end of the primary lever to adopt the position associated with the closure member being fully open and an edge of the recess acts as a guide for the upper end of the primary lever in the event that excessive load is applied to the closure member whilst in the locked open position.

The upper end of the primary lever may be configured to flex relative to the pivot point in the event that an excessive load is applied to the closure member.

The primary lever may be moulded plastic. The secondary lever may be moulded plastic.

In response to an event of excessive load being applied to the closure member, when in the locked open state, the first arm of the primary lever may flex, which causes the upper end and the pin to jump from the slot into the recess, wherein the recess comprises an edge that extends between the extremities of the slot, and wherein the pin is guided against the edge whilst the closure member moves from a locked open position to a closed position. Therefore, in the normal desired operation the presence of the recessed section has no effect on the movement of the upper ends of the primary and secondary levers relative to each other. Only, in the event that an excessive load is applied to the closure member shall the recessed portion become active and effective in ensuring full functionality of the closure mechanism. As such there should be little or no requirement to disassemble the closure mechanism to reset the levers relative to each other.

The recessed section may define an edge that extends between the extremities of the slot, wherein in moving from the locked open position to a closed position the pin will be guided against the edge. As such, in the event that the closure member is inadvertently closed from the locked open position, the orientation of the levers is corrected by the failsafe component such that normal operation of opening and closing the plug can resume.

The primary lever and the secondary lever may be configured and connected to each other at the upper ends such that maximum leverage to move the closure member is realised when the closure member is moved from a closed to an open position.

The pin may be located in the extremity of the foot portion of the slot in a locked open position, an action of applying a load on the closure member acts to rotate the secondary lever in a direction opposite to the direction in which the lock is effective such that the pin locking engagement is ensured under normal operating conditions.

A further aspect of the present invention provides a drain shoe for sanitary ware, the drain shoe comprises:

- a pop-up plug, comprising a stem extending downwards into a hollow body defining a disposal channel between a drain hole of the sanitary ware and an outlet from the body, wherein the pop-up plug is configured open and close the drain hole; and
- a housing, which houses a closure mechanism which is operable to control displacement of the pop-up plug by interaction with the stem, wherein the closure mechanism is operable to displace the pop-up plug relative to the drain hole between an open and a closed position, where the drain hole is open and closed respectively; the closure mechanism comprises a lock feature, which is operable to lock the pop-up plug in an open position.

The primary lever and the secondary lever are configured and connected to each other such that movement relative to each other achieves maximum leverage to move the closure member from a closed to an open position. It will be appreciated that the greatest load is on the closure member when in a closed position and the sanitary ware, for example a walk-in bathtub, is full of water.

The shape and length, of the primary and secondary levers, whether straight or bent, may be influenced by the shape and size of a housing in which they are housed under the sanitary ware to which they are attached. However, the relative positions of the primary lever, secondary lever, upper ends, lower ends and pivot points may be such that the maximum leverage is attainable from a closed position with varying leverage during transition from closed to open.

BRIEF DESCRIPTION OF THE DRAWINGS

Embodiments of the present invention will now be described with reference to the accompanying drawings in which.

DESCRIPTION

Figure 1A:
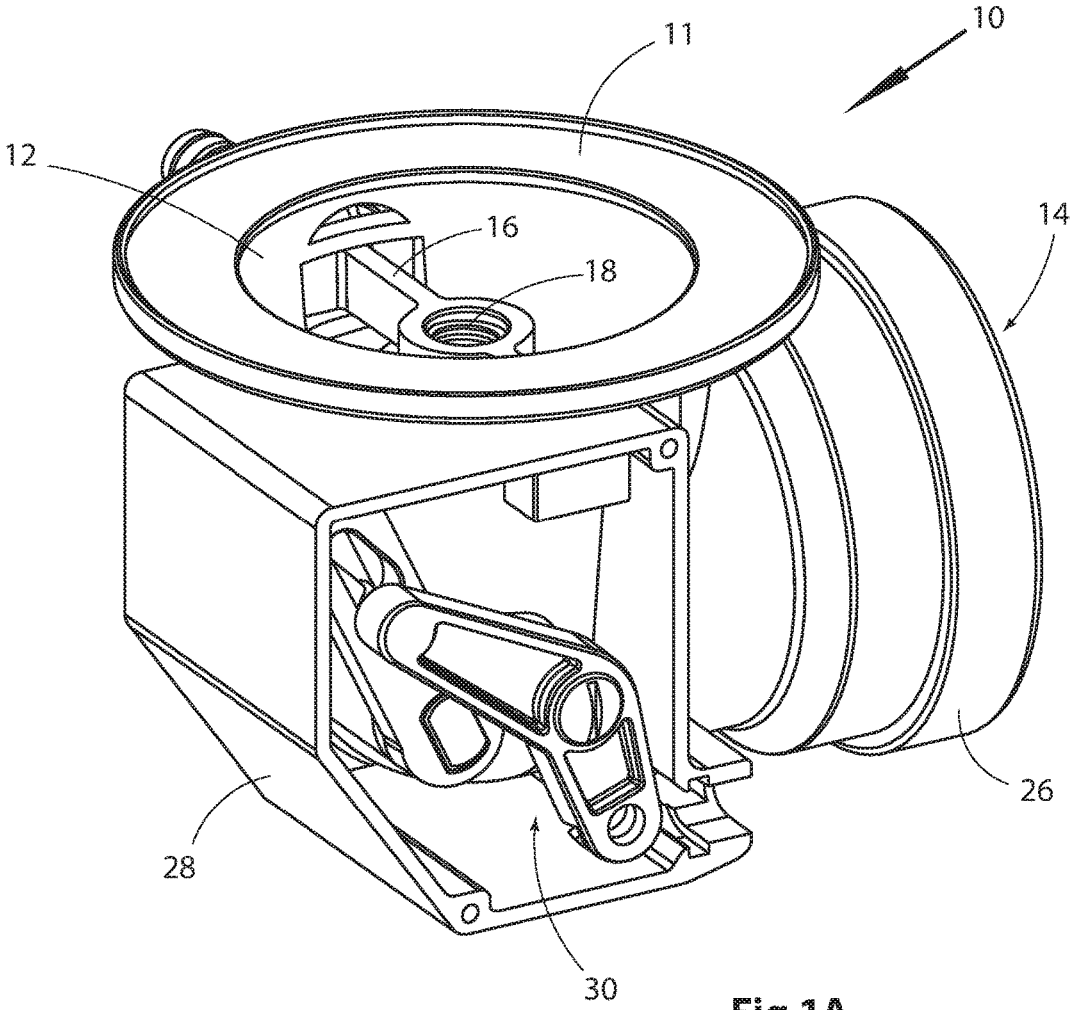
FIG. 1*a* is a schematic representation of a drain shoe for a walk-in bath comprising a closure mechanism according to an embodiment of the present invention.
Figure 1B:
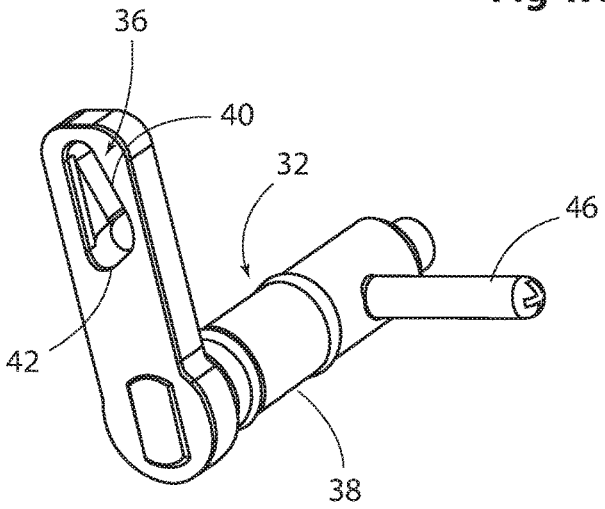
FIG. 1*b* is a schematic representation of a secondary lever of a closure mechanism according to an embodiment of the present invention.

FIG. 1 illustrates a drain shoe 10 intended for use with a walk in bath, where high flow drainage is desirable. The drain shoe 10 includes a hollow body 11 which defines a channel between a drain port 12 and an outlet port 14. The drain port 12 is configured to connect the drain shoe 10 to the underside of a drain hole provided in a bath or the like (not illustrated).

Figure 2A:
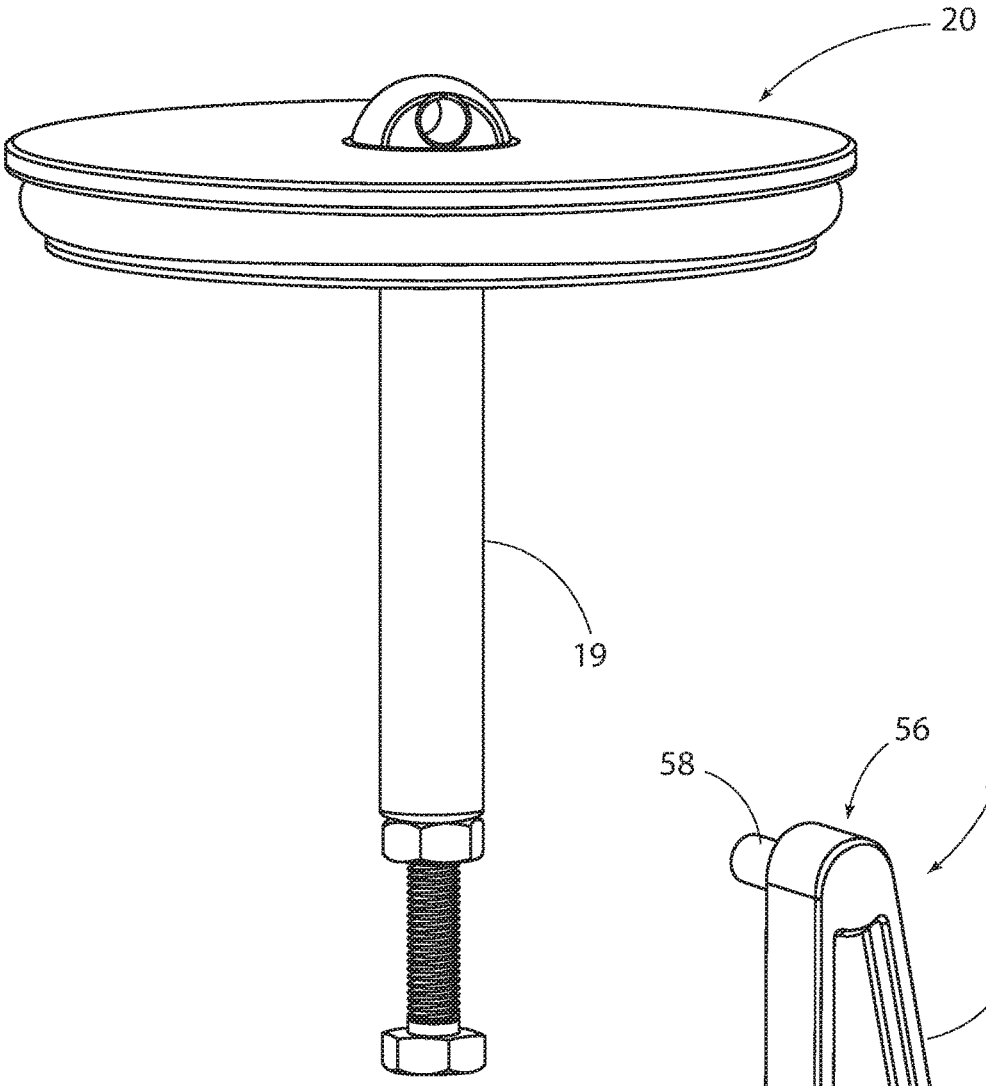
FIG. 2*a* is a schematic representation of a pop-up plug and stem.

In the illustrated embodiment, the drain port 12 includes a cross member 16, which includes a hole 18 in the centre. The hole 18 is configured to receive a stem 19 (see FIG. 2*a*) through it. The stem 19 is attached to and extends down from a pop-up plug 20 (see FIG. 2*a*) into the channel.

The hole 18 at the centre of the cross member 16 acts as a guide to ensure vertical translational movement of the stem 19 to raise and lower the pop-up plug 20.

In a raised position the pop-up plug 20 represents the open position, which allows water to exit the bath via the outlet 14. In the lowered position, the pop-up plug 20 adopts a closed position such that the bath can be filled with water. This will be discussed further below with reference to FIGS. 3 and 4.

The moulded body 11 defines a channel from the drain port 12 to the outlet port 14 and a housing 28. The outlet port 14 facilitates removal of water from the bath to waste. The housing 28 houses a closure mechanism 30 in accordance with an embodiment of the present invention.

In the illustrated embodiment the outlet port 14 includes a threaded end 26, which facilitates connection of the drain shoe 10 to a waste system (not illustrated).

In the illustrated example, the closure mechanism 30 comprises an arrangement of two levers 32, 34 which operate together to impart a load on the stem 19 such that the pop-plug 20 can be raised and lowered.

In the illustrated example, the secondary lever 32 is straight and comprises a J-shaped slot 36 at the upper end and a pivotal shaft 38 at the lower end. The J-shaped slot 36 includes a leg section 40 and a foot section 42 (see FIG. 1*b*), the function of which will be described further below in relation to the primary lever 34.

The pivotal shaft 38 extends into the channel which defines the outlet path from the drain port 12 to the outlet port 14.

A rod 46 is attached to the pivotal shaft 38. The rod 46 extends substantially perpendicular to the rotational axis of the pivotal shaft 38 and is located on the pivotal shaft 38 at a position, within the channel, that aligns with the stem 19 extending down from the pop-up plug 20.

The rod 46 is operable to raise and lower the pop-up plug 20 under the controlled operation of the levers 32, 34, where rotation of the secondary lever 32 causes rotation of the pivotal shaft 38 such that the rod 46 traces an arc, which causes the end of the rod 46 to contact the end of the stem 19 to raise or lower the pop-up plug 20.

Figure 2B:
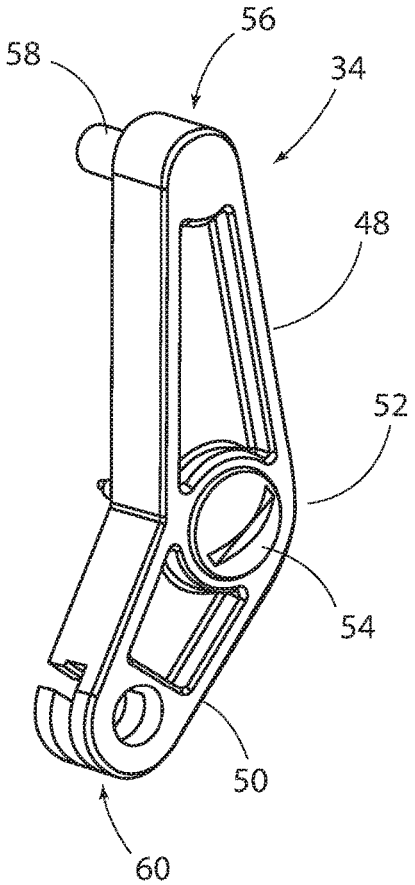
FIG. 2*b*; is a schematic representation of a primary lever of a closure mechanism according to an embodiment of the present invention.

In the illustrated example and with reference to FIG. 2*b*, the primary lever 34, the primary lever, is shaped similar to a boomerang, which includes a first arm section 48 and a second arm section 50 and a bend 52 at the junction of the two arms 48, 50. In the illustrated example, the first arm section 48 is longer than the second arm section 50.

The primary lever 34 includes a pivot point 54, which is coincident with the bend 52.

An upper end 56 of the primary lever 34 includes a pin 58 which, in use, extends in to the housing towards an outside wall of the channel. The pin 58 is received in the slot 36 at the upper end of the secondary lever 32 to engage the upper ends of the two levers 32, 34.

A lower end 60 of the primary lever 34 is attached to a cable or the like such that the operation of the levers 32, 34 can be controlled remotely, for example from a point within the bathtub under which the drain shoe 10 is installed.

It will be appreciated that, in use, the housing 28 will include a cover plate (not illustrated) to conceal the closure mechanism 30. The cover plate may be removable for maintenance or replacement of the closure mechanism 30.

Figure 3:
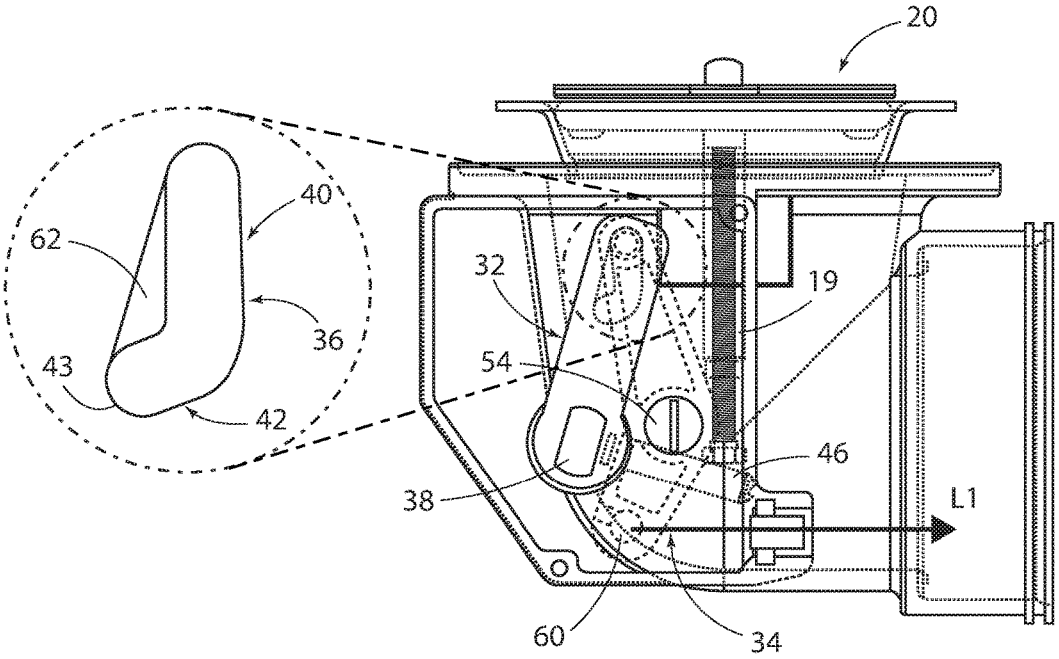
FIG. 3 is a schematic representation of an assembled lockable plug device according to an embodiment of the present invention, the lockable plug device comprises a pop-up plug in a closed position.
Figure 4:
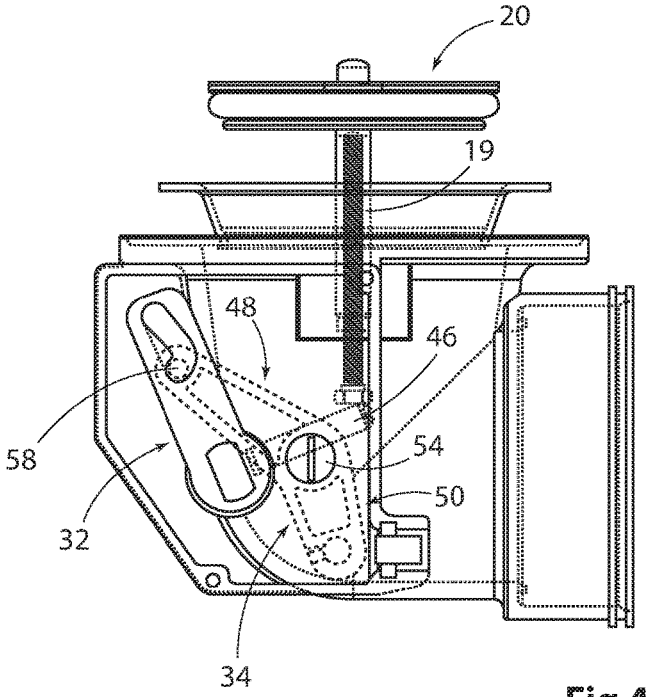
FIG. 4 is a schematic representation of an assembled lockable plug device according to an embodiment of the present invention, the lockable plug device comprises a pop-up plug in an open position.

FIGS. 3 and 4 illustrate the operation of the closure mechanism 30. The operation of the closure mechanism is described further below with reference to the figures.

FIG. 3 illustrates the relative position of the primary lever 34 and the secondary lever 34 when the pop-up plug 20 is in the closed position. This will generally be the situation where the bathtub is full of water and when the pop-up plug 20 is subject to the greatest load acting on it. This represents the status of maximum resistance (effort) and therefore it will be appreciated that this also represents the situation that will require the maximum load to overcome the resistance; the resistance is due to the pressure on the pop-up plug 20 due to the weight of water acting on the plug 20.

The initial leverage L1 (pulling to the right as viewed in FIG. 3) required to lift the plug 20 to an open position will be the largest load required to operate the closure mechanism 30.

The effective length of the primary and secondary levers 32, 34 and the position of the pivot points 38, 54 relative to the load point 60, which is coincident with the lower end of the primary lever 34, delivers the maximum leverage required to raise the pop-up plug 20 to the open position.

To raise the pop-up plug 20, to an open position (as illustrated in FIG. 4), the pin 58 travels along the leg portion 40 of the J-shaped slot 36. The fully open position is reached when the pin 58 comes to rest in the toe section 43 (the toe section 43 acts as a stop) of the foot portion 42 of the J-shaped slot 36 (see FIGS. 1*b*, 3 and 4). This provides a locking function where the secondary lever 32 is locked substantially perpendicular to the axis of the first arm 48 on the primary lever 34.

In normal circumstances, a slight pressure applied on top of the plug 20 would be sufficient to move the plug 20 towards the closed position. This is not the case here, because applying a load (not excessive) on top of the plug 20 acts on the secondary lever 32 via the stem 19 pushing down on the rod 46 to create a clockwise rotation of the secondary lever 32. This action actually enhances the locking function by pushing the pin 58 further towards the toe section 43 of the slot 36. The locking function can only be overridden, via an excessive load being applied to the plug 20.

An excessive load is quantified as a load, which is greater than the load generated by water exiting the bath via the drain port. The override feature to safeguard the closure mechanism 30 is described further below.

In the illustrated example, the primary lever 34 is turned clockwise towards the closed position such that the pin 58 moves from the toe 43 and foot 42 sections of the slot 36 to the leg portion 40 of the slot 36; this releases the lock. When the pin 58 is located in the leg portion 40 of the slot 36, minimal force is required directly on the plug 20 or via the cable to lower and close the plug 30.

The locking function is designed to resist loads comparable to the pressure created due to water draining from the bath, through the drain shoe 10 to waste. As such, inadvertent closure of the plug is avoided whilst emptying the bathtub.

The secondary lever 32 includes a failsafe or override feature, which is operable to allow the plug 20 to close under excessive load conditions, but maintains control of the levers 32, 34 and maintains engagement of the upper ends of the primary lever 34 and the secondary lever 32.

Referring to FIGS. 3 and 4, a triangular portion 62 is evident adjacent to the slot 36. In the illustrated example, the slot 36 is defined through the full thickness of the primary lever 34. The triangular portion 62 is partial thickness and defines a recess cut into the edge of the slot 36.

In the event that an excessive force is applied to the plug 20, for example the plug 20 is stood on, the primary lever 34 will be forced to move in a clockwise direction, but the foot portion 42 of the slot 36 will oppose the motion. As such, the lever 34 will flex and the pin 58 will be forced to jump from the path defined by the slot 36. The triangular portion or recess 62 provides a return track for the pin 58. The return track defines a path along which the pin 58 can travel to reach the top of the leg portion 40 of the slot 36. As described above, when the pin 58 is located at the top of the leg portion 40 this represents the plug 20 in a fully closed position. Therefore, the override facility provided by the recess 60 allows the plug 20 to close in a substantially controlled manner whilst resetting the closure mechanism 30 such that normal operation can resume.

The provision of a recess 60 allows the closure mechanism 30 to be reset in a controlled and contained manner without damage to the closure mechanism 30 or to the plug 20.

The arrangement and configuration of the primary lever 34 and the secondary lever 32 is such that the action of the primary lever 34 relative to secondary lever 32 provides varying leverage through the sweep of the levers 32, 34, where maximum leverage is achieved to dislodge the plug 20 from a closed position as described above with reference to FIG. 2.

As the pin 58 follows the leg portion 40 of the slot 36 (mid-range sweep) the leverage or force required to move the plug 20 is reduced with greater movement.

Whilst specific embodiments of the present invention have been described above, it will be appreciated that departures from the described embodiments may still fall within the scope of the present invention.

What is claimed is:

1. A lockable plug device for sanitary ware, the lockable plug device comprises:

a closure member operable to sealingly engage with an outlet or drain of a sanitary ware product; and a closure mechanism, wherein the closure mechanism is linked to the closure member and is operable to displace the closure member relative to the outlet to open and close the outlet; and wherein the closure mechanism comprises a lock feature, which is operable to lock the closure member in an open position;

wherein the closure mechanism comprises a primary lever and a secondary lever, each comprising an upper end and a lower end;

wherein the upper end of the primary lever engages with the upper end of the secondary lever to control movement of the closure member via the lower end of the secondary lever, wherein the lower end of the primary lever provides a load point, which is operable to rotate the primary lever about a pivot point thereby creating displacement of the upper end of the primary lever and consequential displacement of the upper end of the secondary lever wherein the primary and secondary levers are operable to move to a locked open position, wherein the upper ends of the primary and secondary levers are configured to resist rotational displacement caused by a closing force generated by water flowing through the outlet or the drain wherein the upper end of the secondary lever comprises a slot and the upper end of the primary lever comprises a pin, wherein the pin engages with the slot such that upon rotation of the primary lever relative to the secondary lever the pin is displaced translationally along the slot to an extremity of the slot, wherein rotation of the secondary lever relative to the primary lever displaces the closure member to a locked open position when the pin reaches an extremity of the slot; and the upper end of the secondary lever comprise a recess adjacent to the slot, wherein the recess is shallower than the slot, such that a step is defined to one side of the slot, wherein the step acts as a guide for the upper end of the primary lever to adopt a position associated with the closure member being fully open and an edge of the recess acts as a guide for the upper end of the primary lever in the event that a load, which is greater than the load generated by water flowing through the outlet or the drain, is applied to the closure member whilst in the locked open position.

2. The lockable plug device according to claim 1, wherein the slot comprises a leg portion and a foot portion, wherein the pin locates in the leg portion of the slot when the closure member is in a closed or partially open/closed position and wherein the pin locates in the foot portion of the slot in a locked open position.

3. The lockable plug device according to claim 2, wherein when the pin is located in the extremity of the foot portion of the slot in a locked open position, an action of applying a load on the closure member acts to rotate the secondary lever in a direction opposite to the direction in which the lock is effective such that the pin locking engagement is ensured under normal operating conditions.

4. The lockable plug device according to claim 1, wherein the upper end of the primary lever is configured to flex relative to the pivot point in the event that a load greater than a closing force generated by water flowing through the outlet or the drain is applied to the closure member.

5. The lockable plug device according to claim 4, wherein the primary lever is moulded plastic.

6. The lockable plug device according to claim 4, wherein the secondary lever is moulded plastic.

7. The lockable plug device according to claim 1, wherein, in response to an event of a load greater than a closing force generated by water generated by water flowing through the outlet or the drain, being applied to the closure member when in the locked open position, the upper end of the primary lever flexes, which causes the pin to jump from the slot into the recess, wherein the recess comprises an edge that extends between the extremities of the slot, and wherein moving the closure member from a locked open position to a closed position the pin is guided against the edge.

8. The lockable plug device according to claim 1, wherein the pivot point is located centrally between the upper end and lower end of the primary lever, and wherein the pivot point divides the primary lever into a first arm and a second arm.

9. The lockable plug device according to claim 8, wherein the first arm extends between the upper end and the pivot point and the second arm extends between the lower end and the pivot point, wherein the first arm is longer than the second aim.

10. The lockable plug device according to claim 1, wherein the secondary lever is straight.

11. The lockable plug device according to any claim 1, wherein the primary lever comprises a bend, wherein the pivot point is located at the bend.

12. The lockable plug device according to claim 1, wherein the secondary lever comprises a pivotal member coincident with the lower end of the secondary lever.

13. The lockable plug device according to claim 12, wherein the pivotal member is configured to rotate upon rotation of the secondary lever relative to the primary lever, and includes an extension member extending perpendicular to a rotational axis of the pivotal member, wherein the extension member is operable to interact with the closure member to displace the closure member between open and closed positions.

14. The lockable plug device according to claim 13, wherein the extension member extends, substantially perpendicular to a rotational axis of the pivotal member such that upon rotation of the secondary lever pivotal member rotates and the extension member traces an arc and thereby interacts with the closure member to provide directional displacement of the closure member.

15. The lockable plug device according to claim 14, wherein the extension member is a rod.

16. The lockable plug device according to claim 1, wherein the primary and secondary levers are arranged relative to each other such that intentional closure of the closure member is controlled by applying a load to the lower end of the primary lever to rotate the upper end relative to the pivot point.

17. The lockable plug device according to claim 1, wherein the primary lever and the secondary lever are connected to each other at the upper ends, wherein the effective length of the primary and secondary levers and the position of the pivot point relative to a load point that is coincident with the lower end of the primary lever are dimensioned to apply sufficient load to raise the closure member from a closed to an open position.

* * * * *